US011274452B2

(12) United States Patent
Loebel et al.

(10) Patent No.: US 11,274,452 B2
(45) **Date of Patent: *Mar. 15, 2022**

(54) PANEL

(71) Applicant: AKZENTA PANEELE + PROFILE GMBH, Kaisersesch (DE)

(72) Inventors: Arne Loebel, Düsseldorf (DE); Erich Schäfers, Demerath (DE)

(73) Assignee: AKZENTA PANEELE + PROFILE GMBH, Kaisersesch (DE)

( * ) Notice: Subject to any disclaimer, the term of this patent is extended or adjusted under 35 U.S.C. 154(b) by 0 days.

This patent is subject to a terminal disclaimer.

(21) Appl. No.: 16/576,262

(22) Filed: Sep. 19, 2019

(65) Prior Publication Data

US 2020/0011067 A1 Jan. 9, 2020

Related U.S. Application Data

(63) Continuation of application No. 15/746,639, filed as application No. PCT/EP2016/067445 on Jul. 21, 2016, now Pat. No. 10,458,124.

(30) Foreign Application Priority Data

Jul. 22, 2015 (DE) ..... 10 2015 111 930.7

(51) Int. Cl.

| | |
|---|---|
| ***E04B 2/00*** | (2006.01) |
| ***E04F 15/02*** | (2006.01) |
| ***E04F 13/08*** | (2006.01) |
| ***E04F 15/04*** | (2006.01) |
| ***E04F 15/18*** | (2006.01) |

(52) U.S. Cl.

CPC .... *E04F 15/02033* (2013.01); *E04F 13/0894* (2013.01); *E04F 15/02038* (2013.01); *E04F 15/02155* (2013.01); *E04F 15/042* (2013.01); *E04F 15/181* (2013.01); *E04F 2201/0107* (2013.01); *E04F 2201/0115* (2013.01); *E04F 2201/026* (2013.01)

(58) Field of Classification Search

None

See application file for complete search history.

(56) References Cited

U.S. PATENT DOCUMENTS

| | | | |
|---|---|---|---|
| 444,042 | A | 1/1891 | Brock |
| 3,204,380 | A | 9/1965 | Smith |
| 4,075,805 | A | 2/1978 | Bongiovanni |

(Continued)

FOREIGN PATENT DOCUMENTS

| | | | |
|---|---|---|---|
| CN | 102652201 | A | 8/2012 |
| DE | 10256501 | A1 | 7/2004 |

(Continued)

*Primary Examiner* — Basil S Katcheves

(74) *Attorney, Agent, or Firm* — Lucas & Mercanti, LLP; Klaus P. Stoffel

(57) ABSTRACT

A panel having a panel upper side and a panel lower side and at least two opposing panel edges, which have each an edge break on the panel upper side, the edge breaks forming in the connected state a joint in a covering surface. The edge break of one of the panel edges is formed larger than the edge break of the opposing panel edge, and a lower part of the large edge break of the one panel edge is overlapped in the connected state by the small edge break of the opposing panel edge.

12 Claims, 5 Drawing Sheets

(56) References Cited

U.S. PATENT DOCUMENTS

| | | | | |
|---|---|---|---|---|
| 4,807,416 | A | 2/1989 | Parasin | |
| 8,176,698 | B2 | 5/2012 | Lewark | |
| 8,365,488 | B2 | 2/2013 | Chen | |
| 9,315,994 | B2 | 4/2016 | Chen | |
| 9,828,777 | B2 | 11/2017 | Dohring | |
| 10,458,124 | B2 * | 10/2019 | Loebel | E04F 15/181 |
| 2002/0014047 | A1 | 2/2002 | Thiers | |
| 2002/0142135 | A1 | 10/2002 | Chen | |
| 2005/0166514 | A1 | 8/2005 | Pervan | |
| 2006/0179773 | A1 | 8/2006 | Pervan | |
| 2006/0260242 | A1 | 11/2006 | Boucke | |
| 2010/0018149 | A1 | 1/2010 | Thiers | |
| 2011/0114224 | A1 | 5/2011 | Fridlund | |
| 2011/0146188 | A1 | 6/2011 | Wallin | |
| 2012/0247042 | A1 | 10/2012 | Clancy | |
| 2017/0030088 | A1 | 2/2017 | Simoens | |

FOREIGN PATENT DOCUMENTS

| | | | |
|---|---|---|---|
| DE | 102006030852 | A1 | 11/2007 |
| DE | 102011111166 | A1 | 2/2013 |
| DE | 202014005148 | U1 | 7/2014 |
| FR | 2063228 | A5 | 7/1971 |
| FR | H07189466 | A | 7/1971 |
| JP | H04113642 | A | 4/1992 |
| WO | 2011114387 | A1 | 9/2011 |

* cited by examiner

PANEL

CROSS-REFERENCE TO RELATED APPLICATIONS

The present application is a Continuation Application of U.S. patent application Ser. No. 15/746,639, filed Jan. 22, 2018, which is a 371 of International Application PCT/EP2016/067445, filed Jul. 21, 2016, which claims priority of DE 10 2015 111 930.7, filed Jul. 22, 2015, the priority of these applications is hereby claimed and these applications are incorporated herein by reference.

BACKGROUND OF THE INVENTION

The invention concerns a panel having a panel top side and a panel underside and at least two mutually opposite panel edges, which respectively have an edge break at the panel top side, wherein the edge breaks in turn in the connected condition together form a join in a covering surface.

The panels usually have decorative surfaces. In particular the invention relates to a panel of the above-indicated general kind which is intended for adhesive bonding to a supporting substrate. Such panels are used for example as floor panels and are glued on a floor screed and so forth. The mutually opposite panel edges of the proposed panel have contoured panel edges which are of a mutually complementary configuration, that is to say in principle two panel edges of the same panel can be joined together if the panel were cut apart. When laying panels it is quite usual for the last panel at the end of a row of panels to be shortened as required if the space is not sufficient to place the full panel at the end of a row of panels.

Panels which are intended for adhesive bonding to a substrate frequently dispense with contoured panel edges. Then they have simply flat panel edges which are arranged perpendicularly to the panel top side and which are fitted together in butting relationship. On the other hand, panels having contoured panel edges are known, which have a complementary groove and tongue for adhesive laying of the panels. Groove and tongue panels can also be glued to the substrate, but in many cases they are intended for floating laying and are not glued to the substrate. In that case only the groove and tongue edges are glued together.

The edge breaks at the top at the panel edges represent a blunting effect which makes the respective edge less sensitive to mechanical shocks and in that way protects the panel edges. The butting join of panels which are fitted together can in practice turn out to be irregular. Although panel edges are pressed together when they are adhesively bonded on a substrate inclined positions and gaps can occur, which disrupt a desired uniform appearance for a coating surface. In that respect edge breaks which together form a join or notch contribute to concealing a little irregularities like inclined positions or gaps.

SUMMARY OF THE INVENTION

The invention is based on the problem of proposing a panel intended for adhesive laying on a substrate and having an improved configuration of at least two mutually opposite panel edges.

According to the invention that object is attained in that the edge break of one of the panel edges is larger than the edge break of the opposite panel edge and that a lower part of the large edge break of the one panel edge in the connected condition is overlapped by the small edge break of the opposite panel edge.

The new configuration of the mutually opposite panel edges provides that any gap is less conspicuous than in the case of a covering surface consisting of known panels. When the edge breaks of two panel edges are fitted together to form of join there can admittedly be a gap at the bottom of the join. By virtue of the configuration of the large edge break and the small edge break however a gap can never occur, which would be visible for a viewer perpendicularly from above. As a result the appearance of a covering surface is disrupted much less than in the case of a covering surface consisting of known panels.

In addition the configuration of the panel edges is particularly well suited when the panel overall is to be of a very thin configuration.

Desirably, provided at a panel edge in an upper region near the panel top side there is an undercut contour having a lateral projection, wherein the small edge break is disposed upwardly at the lateral projection of that contour.

Preferably the lateral projection forms the distal region of the panel edge. No other region of the panel edge projects laterally further than that lateral projection.

There is a further benefit if the lateral projection has a locking surface facing towards the panel underside.

It is also helpful for the overlapped part of the large edge break in the connected condition to be oriented parallel to the locking surface which is provided at the contour of the lateral projection.

In any case the overlapped region of the large edge break cannot move unimpededly perpendicularly to the panel plane in the direction of the panel top side because the locking surface of the lateral projection blocks the way.

It is also helpful if a set-back butting surface is provided between the panel underside and the lateral projection. That butting surface delimits the joining path of movement when two panels are moved in the panel plane and perpendicularly to their panel edges relative to each other.

Desirably the free end of the complementary panel edge also has a butting surface which cooperates with the above-mentioned butting surface arranged beneath the lateral projection. When the butting surfaces of the complementary panel edges are oriented perpendicularly to the panel plane, that avoids the occurrence of a force component which acts perpendicularly to the panel plane and which could involve an unwanted heightwise displacement of the panel edges.

The mutually opposite panel edges can respectively have a lower edge break at the panel underside. Here too the blunting effect afforded thereby protects the respective edge from damage. The edge breaks also form a join at the underside of the covering. That join promotes adhesive bonding insofar as adhesive which has been applied to the panel underside can flow as far as the underside join. Accordingly adhesive passes at least a distance between the panel edges and can certainly also pass between the butting surfaces and glue them together, whereby an additional adhesive bond is produced between the butting surfaces and the strength of that connection is improved.

That panel edge having the lateral projection can have a lower edge break which is of equal size to or larger than the lower edge break of the complementary panel edge. That configuration for example can be of such a design that the large edge break at the panel underside extends to such an extent that it intersects the small edge break at the panel top side. The entire panel edge then forms an asymmetrical point in which each of the two edge breaks forms a flank of that point. The two flanks of the point can differ in respect of size, angle and surface shape. The surfaces do not have to be for example planes.

The panel underside can be prepared as an adhesive underside. This can then involve an adhesive strip which is applied to the panel underside or for example an adhesive which has to be activated to deploy its adhesive action.

In an alternative the adhesive underside is afforded by the surface nature of the panel underside being prepared to provide for good adhesion of an adhesive. The adhesive is then applied during the manufacture of a covering surface.

For the purposes of producing a covering surface, a method for adhesively fitting a panel according to the invention is proposed, in which the adhesive is applied to the panel underside, but in that case an edge region of the panel underside remains free of adhesive. An edge region extending peripherally at the underside of the panel is not provided with adhesive.

When the panel is pressed against the substrate the adhesive can flow to the edge region of the panel underside and passes in part between the panel edges.

In regard to the adhesive or the glue that can be for example a reactive adhesive or reaction adhesive. In that respect the term reaction adhesive can denote in particular such an adhesive whose hardening is based on a chemical reaction like for example polymerization, for example polyaddition or polycondensation. In particular large-molecular, cross-linked plastics of high strength are the result of the reaction.

Essentially two reaction partners are involved in the reaction. The reaction partners can be brought together and mixed for example immediately prior to processing, in which case this is a 2-component adhesives. Alternatively it is possible to use a 1-component adhesive if one of the two components is contained hidden in the adhesive system or if both components are present freely, but a reaction takes place only under given conditions.

In particular such a reaction adhesive includes resin and a hardener for same. By mixing the two reactants or bringing them into contact with each other or by setting suitable reaction conditions hardening is triggered off and thus a stable adhesive composite is produced.

Adhesive systems by way of example include for instance epoxy systems, in which case for example an epoxy resin as the main component and also a hardener for the main component like for example amines or acid hardeners like for example carboxylic acid anhydrides can be added. In addition it is possible to use polyurethane-based systems in which the reaction components can have polyols as the main component and isocyanates as the hardener. It is also possible to use prepolymers which can harden by virtue of suitable functional groups with the addition of a suitable hardener.

In particular however with no restriction to the use of reaction adhesives, it is possible to use an adhesive system which is activatable. In other words it can be provided that an adhesive action on the part of the adhesive occurs only after activation and therefore for example only immediately prior to laying of the panels or even only after laying thereof.

It can thus be particularly preferred if the panel underside which is prepared as an adhesive underside is provided with an adhesive, wherein, in a condition in which the panel can for example be marketed, the panel underside is not or is only limitedly adhesive but is activatable in order to bring about or enhance the adhesive properties upon laying.

In principle activation of the adhesive which as described hereinbefore can be for example a one-component adhesive or a two-component adhesive, can be effected in various ways. Examples of activatable adhesives or glues include those systems which can be activated by the mixing of two substances, in light-induced fashion, for example by UV-radiation, in pressure-induced fashion, in temperature-induced fashion and/or in some other way.

In regard to mixing two substances and in that respect in particular in regard to two-component systems, it can be provided for example that a component like for example a resin or resin base material is applied to the panel and the further component like for example the hardener is applied to the surface to be covered, or vice-versa. An adequate adhesive action therefore occurs only immediately when the panel is laid. In contrast, prior to laying, the panel has as yet no or only reduced adhesive properties.

In regard to light-induced systems or systems which harden by photo-initiation, epoxy systems can be named by way of example. In particular light-activatable and UV-hardening adhesives can be summarized among epoxy resins which harden by photo-initiation, like for example epoxysiloxanes. In that respect a photo-initiator contained in the adhesive mixture can release light-activatable substances which start polymerization of epoxy resins upon irradiation with visible light in a wavelength range by way of example of between 400 and 550 nm (VIS-initiator). The photo-initiator can be for example an aryldiazonium salt, a pyridium salt, a phosphonium salt or the like. In the case of the UV-hardening products that can occur during the action of UVA-light of the wavelength range by way of example of between 310 and 380 nm, in which case the photo-initiator can be for example a hexafluorophosphate salt. In the case of such systems the adhesive which has the main substance like for example the epoxy resin and the photo-initiator can be applied to the panel and activated only immediately prior to laying by irradiation with light. For that purpose for example a light-impermeable adhesive film can be removed from the adhesive layer immediately prior to laying in order in that way to start light-induced hardening. In addition suitable lamps can improve or start light-induced hardening.

Pressure-induced systems can be based for example on a one-component system or on a two-component system, as were described hereinbefore. In that case the activator component or the hardener can be arranged for example in a capsule which is disposed in the matrix of the first adhesive component like for example the resin. That capsule can then for example be of such a nature that it can be destroyed under the application of a particularly defined pressure so that the two components mix and hardening can thus be effected. That can be implemented for example involving a capsule having a capsule wall which is of a stability or thickness corresponding to the destruction pressure. Thus for example the panel can first be laid and then the adhesive can be activated by a pressure on the panel from above. That firstly permits partial or complete laying of panels, whereupon the adhesive can be activated and the adhesive action deployed in a laid condition of the panels by specifically targeted pressure. It will be appreciated that activation can also take place prior to laying.

In a further configuration capsules or capsule walls can be dissolved or disrupted by the action of a solvent so that a substance in the capsules can mix with the main component like for example the resin. In this configuration therefore activation can be effected in solvent-induced fashion.

The latter can also be effected if for example reactivation take place, insofar as a dry adhesive again acquires adhesive properties with the aid of a solvent. For example it is possible for the adhesive to be softened and made sticky by means of a volatile organic solvent or vapor thereof. In that respect the selection of the solvent is dependent on the specifically selected adhesive system, in a manner known to the man skilled in the art.

In regard to the above-mentioned capsules it is further possible for them to be destroyed by ultrasound radiation or by microwave radiation in order in that way to permit mixing of the components. That configuration therefore involves radiation-induced activation.

In relation to temperature-induced or heat-induced adhesives it is possible for example to use systems which are based on polyurethane, polyvinylidene chloride, polyvinyl acetate and polyacrylate, in the form of a dispersion or in an organic solvent. Such systems can be activated for example by the action of heat so that after at least partial laying for example or even prior to laying the adhesive can be activated and can thus deploy its adhesive action. In that respect comparatively low temperatures of for example 60° C. can already suffice to activate the adhesive. In dependence on the desired application however it may also be advantageous to adopt higher activation temperatures so as to prevent unwanted activation of the adhesive.

Further possible ways of specifically causing an adhesive condition to occur or activating the adhesive include for example coverings the adhesive like for example an adhesive layer with a releasable coating. For that purpose it is possible to use for example a plastic film which can be removed when required.

The panels according to the invention preferably substantially comprise a carrier or core of a solid material, for example a wood material, which is provided on at least one side with a decorative layer and a cover layer and optionally with further layers, for example a wearing layer disposed between the decorative layer and the cover layer.

In that respect, "wood materials" in accordance with the invention, besides solid wood materials, are also materials like for example cross-laminated board, laminated board, blockboard, veneered plywood, veneered laminated wood, veneered strip wood and bending plywood. In addition the term wood materials in accordance with the invention is also used to denote particle board like for example pressed chipboard, extruded chipboard, oriented structural board (OSB) and strip chipboard and also wood fiber materials like for example wood fiber insulating boards (HDF), medium-hard and hard fiber boards (MB, HFH) and in particular medium-density fiber boards (MDF) and high-density fiber boards (HDF). Modern wood materials like wood-polymer materials (wood plastic composite, WPC), sandwich boards comprising a light core material like foam, hard foam or paper honeycomb and a wood layer applied thereto, as well as chipboard bound with mineral, for example with cement, form wood materials in accordance with the invention. In that respect cork also represents a wood material in accordance with the invention.

In accordance with the invention the term "fiber materials" is used to denote materials like for example paper and non-woven materials on the basis of vegetable, animal, mineral and also synthetic fibers, as well as cardboards. Examples are fiber materials made from vegetable fibers and besides papers and non-woven materials of pulp fibers boards of biomass like straw, maize straw, bamboo, greenery, alga extract, hemp, cotton or oil palm fibers. Examples of animal fiber materials are for example keratin-based materials like for example wool or horsehair. Examples of mineral fiber materials are made of mineral wood or glass wool.

According to a configuration a carrier or a carrier board based on a plastic or a wood-plastic composite material (WPC) can be used for a panel according to the invention. For example the carrier board can be formed from a thermoplastic, elastomeric, or thermosetting plastic. Recycling materials from the specified materials can be used in the context of the panel according to the invention. In that respect preferred carrier board materials can be in particular thermoplastic materials like polyvinyl chloride, polyolefins (for example polyethylene (PE), polypropylene (PP), polyamides (PA), polyurethane (PU), polystyrene (PS), acrylonitrile-butadiene-styrene (ABS), polymethyl methacrylate (PWMA), polycarbonate (PC), polyethylene terephalate (PET), polyether etherketone (PEEK) or mixtures or copolymers thereof. In that respect independently of the base material of the carrier it is possible to provide for example plasticizers which can be present for example in a range of between >0% by weight and ≤20% by weight, in particular ≤10% by weight, preferably ≤7% by weight, for example in a range of between ≥5% by weight and ≤10% by weight. A suitable plasticizer includes for example the plasticizer marketed by BASF under the trade name "Dinsch". In addition copolymers like for example acrylates or methacrylates can be provided as a substitute for conventional plasticizers. In addition in this configuration the carrier can be cooled to a temperature below the melting temperature of the plastic component, in or before the two-belt press. In a preferred configuration of the invention the carrier board is substantially free of plasticizers, in which respect the expression "substantially free of plasticizers" in accordance with the invention is used to mean a plasticizer concentration <<1%.

In particular thermoplastic materials also afford the advantage that the products produced therefrom can be very easily recycled. It is also possible to use recycling materials from other sources. That affords a further possible option for reducing the manufacturing costs in the manufacture of panels according to the invention.

In that respect such carriers are very elastic or springy, which allows a comfortable impression when walking thereon and in addition can reduce the noise occurring when walking thereon in comparison with conventional materials so that it is possible to achieve an improved footstep sound.

In addition the above-mentioned carriers afford the advantage of good water resistance as they involve a swelling of 1% or less. Besides pure plastic carriers, that surprisingly also applies to WPC materials, as are described in detail hereinafter.

In a particularly advantageous fashion the carrier material can have or consist of wood-polymer materials (wood plastic composite, WPC). Here for example a wood and a polymer can be suitable, which can be present in a ratio of between 40/60 and 70/30, for example 50/50. For example polypropylene, polyethylene or a copolymer of the two afore-mentioned materials can be used as the polymer components, while in addition wood powder can be used as the wood component.

In addition the above-described carrier boards based on such WPC materials exhibit good water compatibility with a degree of swelling of less than 1%. In that respect WPC materials have for example stabilizers and/or other additives which can preferably occur in the plastic component.

In addition it can be particularly advantageous for the carrier material to include or consist of a PVC-based material. Such materials can also serve in a particularly advantageous fashion for high-quality panels which can be used without any problem for example even in wet rooms.

Furthermore PVC-based carrier materials also present themselves for a particularly effective manufacturing process as here for example line speeds of 8 m/min with a product thickness for example of 4.1 mm can be possible, which can permit a particularly effective manufacturing process. Furthermore such carriers also enjoy advantageous elasticity and water compatibility, which can lead to the above-mentioned advantages.

In relation to plastic-based panels and also in relation to WPC-based panels, for example based on polypropylene, mineral fillers can be of advantage in that respect. Here for example talcum or talc or also calcium carbonate (chalk), aluminum oxides, silica gel, quartz flour, wood powder and gypsum are particularly suitable. For example it is possible to use chalk. The proportion of the mineral fillers can be in a range of between ≥30% by weight and ≤80% by weight, for example between ≥45% by weight and ≤70% by weight. Slippage of the carrier can be improved by the fillers, in particular the chalk. When using talcum, for example, it may then be possible to achieve improved heat resistance and humidity resistance. The fillers can also be colored in known fashion. For example there may be a mixture of talcum and polypropylene in which talcum is present in the above-mentioned quantitative range, for example at about 60% by weight. In particular it can be provided that the board material has a flame-proofing agent.

In a particularly preferred configuration of the invention the carrier material comprises a mixture of a PE/PP block copolymer with wood. In that respect the proportion of the PE/PP block copolymer and the proportion of the wood can be between ≥45% by weight and ≤55% by weight. Furthermore the carrier material can have between ≥0% by weight and ≥10% by weight of further additives like for example flow aids, thermostabilizers or UV-stabilizers. The particle size of the wood in that case is between >0 μm and ≤600 μm with a preferred particle size distribution D50 of ≥400 μm. In particular in that case the carrier material can have wood with a particle size distribution D10 of ≥400 μm. The particle size distribution in that respect is related to the volumetric diameter and relates to the volume of the particles.

In a further preferred configuration of the invention the carrier material comprises a mixture of a PE/PP polymer blend with wood. In that case the proportion of PE/PP polymer blend and the proportion of the wood can be between ≥45% by weight and ≤55% by weight. Furthermore the carrier material can have between ≥0% by weight and ≤10% by weight of further additives like for example flow aids, thermostabilizers or UV-stabilizers. The particle size of the wood in that case is between ≥0 μm and ≤600 μm with a preferred particle size distribution D50 of ≥400 μm. In particular in that case the carrier material can have wood with a particle size distribution D10 of ≥400 μm. The particles size distribution in that respect is related to the volumetric diameter and relates to the volume of the particles. Particularly preferably in that respect the carrier material is prepared in the form of a granulated or pelleted pre-extruded mixture from a PE/PP polymer blend with wood particles of the specified particle size distribution.

In a further configuration of the invention the carrier material comprises a mixture of a PP homopolymer with wood. In that case the proportion of the PP homopolymer and the wood proportion can be between ≥45% by weight and ≤55% by weight. For example the components wood and polypropylene can be present in a ratio of between 0.5:1 and 1:0.5, for example 1:1. In addition the carrier material can have between ≥0% by weight and ≤10% by weight of further additives like for example flow aids, thermostabilizers or UV-stabilizers. The particle size of the wood in that case is between >0 μm and ≤600 μm with a preferred particle size distribution D50 of ≥400 μm. In particular in that respect the carrier material can have wood of a particle size distribution D10 of ≥400 μm. The particle size distribution is related in that case to the volumetric diameter and relates to the volume of the particles. Particularly preferably the carrier material is prepared in the form of granulated or pelleted pre-extruded mixture consisting of a PP homopolymer with wood particles of the specified particle size distribution. The granular material and/or the pellets can preferably be for example of a grain size in a range of between ≥400 μm and ≤10 mm, preferably between ≥600 μm and ≤10 mm, in particular between ≥800 μm and ≤10 mm. In a further configuration of the invention the carrier material comprises a mixture of a PVC polymer with chalk. In that case the proportion of the PVC polymer and the chalk proportion can be between ≥45% by weight and ≤55% by weight. Furthermore the carrier material can have between ≥0% by weight and ≤10% by weight of further additives like for example flow aids, thermostabilizers or UV-stabilizers. The particle size of the chalk in that case is between >0 μm and ≤1000 μm, for example between ≥800 μm and ≤1000 μm, with a preferred particle size distribution D50 of ≥400 μm, for example ≥600 μm. In particular the carrier material can in that case involve chalk with a particle size distribution D10 of ≥400 μm, for example ≥600 μm. The particle size distribution is related in that case to the volumetric diameter and relates to the volume of the particles. Particularly preferably in that case the carrier material is prepared in the form of granulated or pelleted pre-extruded mixture consisting of a PVC polymer with chalk of the specified particle size distribution. The granular material and/or the pellets can in that case preferably be for example of a grain size in a range of between ≥400 μm and ≤10 mm, preferably ≥600 μm and ≤10 mm, in particular between ≥800 μm and ≤10 mm, for example ≥1000 μm and ≤10 mm.

In a further configuration of the invention the carrier material comprises a mixture of a PVC polymer with wood. The proportion of the PVC polymer and the wood proportion can be between ≥45% by weight and ≤55% by weight. Furthermore the carrier material can have between ≥0% by weight and ≤10% by weight of further additives like for example flow aids, thermostabilizers or UV-stabilizers. The particle size of the wood in that case is between >0 μm and ≤1000 μm, for example between ≥800 μm and ≤1000 μm, with a preferred particle size distribution D50 of ≥400 μm, for example ≥600 μm. In particular the carrier material can have wood of a particle size distribution D10 of ≥400 μm, for example ≥600 μm. The particle distribution in that case is related to the volumetric diameter and relates to the volume of the particles. Particularly preferably in that case the carrier material is prepared in the form of a granulated or pelleted pre-extruded mixture comprising a PVC polymer with wood particles of the specified particle size distribution.

For determining the particle size distribution, it is possible to have recourse to the generally known methods like for example laser diffractometry, with which it is possible to determine particles sizes in the range of between some nanometers to several millimeters. By means of that method it is also possible to determine D50 and D10 values in respect of which 50% and 10% respectively of the measured particles are smaller than the specified value.

In accordance with a further configuration the carrier material can have hollow microspheres. Such additives can provide in particular that the density of the carrier and thus the panel produced therefrom can be significantly reduced so that it is possible to ensure particularly simple and inexpensive transport and also particularly comfortable laying. In that case stability of the panel produced can be guaranteed in particular by the inclusion of hollow microspheres, the stability not being significantly reduced in comparison with a material without hollow microspheres. Thus the stability for a large part of applications is totally adequate. In this respect the term hollow microspheres can denote in particular structures which have a hollow main body and are of a size and a maximum diameter which is in the micrometer range. For example hollow spheres which can be used can be of a diameter which is in the range of between ≥5 μm and ≤100 μm, for example between ≥20 μm and ≤50 μm. In principle any material can be considered as the material of the hollow microspheres, like for example glass or ceramic. In addition by virtue of the weight plastic materials, for example the plastics which are also used in the carrier material, for example PVC, PE or PP, can be advantageous, in which case, for example by virtue of suitable additives, they can possibly be prevented from deformation during the manufacturing procedure.

In accordance with a further configuration a fiber material can be incorporated into the carrier. For example a glass fiber non-woven material can be used in the carrier material in this configuration. In this configuration, a carrier can be produced with a particularly high level of load-carrying capacity or stability as the strength of the carrier can be significantly increased by the incorporated fiber material. In addition in this configuration the carrier can be particularly cut to size as for example the provision of a plurality of spreading units, as is described in detail hereinbefore, means that the carrier material can be adjusted as desired for example above and below the non-woven material. In addition a structure which can still be cut to size can be enabled by the provision of a plurality of fiber material webs, wherein the carrier material can in turn be adapted as desired or varied.

A preferred area of use for the panel are floor coverings. It will be appreciated however that panels according to the invention can also be used for wall coverings, ceiling coverings or coverings for surfaces of articles of furniture. They are suitable for example as an alternative or as replacement for wall and floor tiles and in particular depending on the respective choice of material also for use in wet rooms.

Irrespective of the exact configuration of the panel but in particular in dependence on the locking shape it can be of a thickness in a range of for example between ≥1.5 mm and ≤5.0 mm, preferably between ≥1.5 mm and ≤3.5 mm and particularly preferably between ≥2 mm and ≥2.8 mm.

In a development the panel can be provided with a recess in matching relationship with the projection at the complementary panel edge. The recess can be of a wedge-shaped configuration and can have a recess surface which is of an undercut configuration as viewed from the panel top side. A lower surface of the recess can of such a configuration that it blends for example in aligned relationship into a locking surface which is provided for cooperation with a locking surface of the complementary panel edge.

In the assembled condition the large edge break can be overlapped by the undercut recess surface, wherein a gap can then advantageously be provided between the large edge break and that recess surface.

Desirably provided beneath the locking surfaces at the complementary panel edges is a respective butting surface arranged substantially perpendicularly to the panel plane.

It applies to the butting surfaces of all embodiments that alternatively in the assembled condition they can be arranged with a slight inclination in mutually parallel relationship. In that case the inclination is preferably in opposite relationship to that direction in which the locking surface arranged thereabove is inclined. In conjunction with the complementary locking surfaces that produces a centering action for the panel edges and a positively locking action which opposes movement of the panels away from each other in a direction perpendicular to the panel plane.

In another development of the panel a projection can be provided at that panel edge having the large edge break, which projection at the free end preferably is of a round cross-section or is of a rounded configuration. That complementary panel edge then preferably has a recess of a matching configuration, possibly with a matching rounded configuration. In the assembled condition the projection and the recess center the panel edges relative to each other and in particular provide a locking action to prevent the panels from moving apart in a direction perpendicularly to the panel plane. A lower wall of the recess has a free end which in the assembled condition desirably ends at a spacing in front of the complementary panel edge.

The various features of novelty which characterize the invention are pointed out with particularity in the claims annexed to and forming a part of the disclosure. For a better understanding of the invention, its operating advantages, specific objects attained by its use, reference should be had to the drawings and descriptive matter in which there are illustrated and described preferred embodiments of the invention.

DETAILED DESCRIPTION OF THE INVENTION

Figure 1:
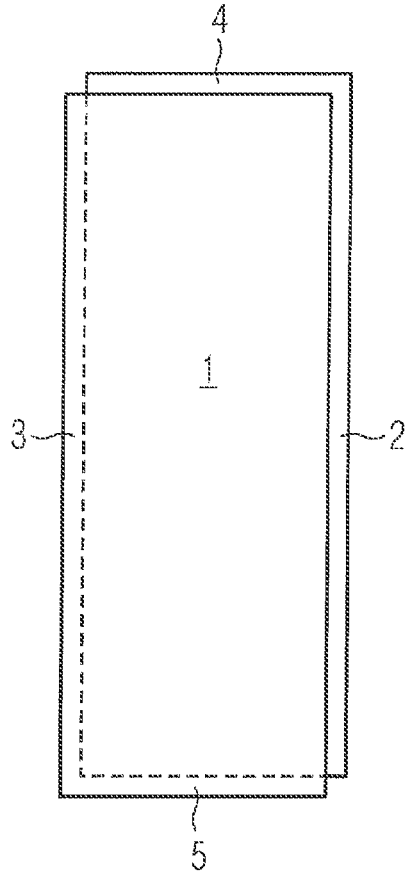
FIG. 1 shows a diagrammatic plan view of a panel according to the invention of rectangular shape.

The example shown in FIG. 1 involves a panel 1 of a rectangular base surface. The panel has two pairs of edges, whose panel edges 2, 3 and 4, 5 respectively are respectively disposed in paired opposite relationship. The panel edges are provided with panel edges according to the invention.

Figure 2:
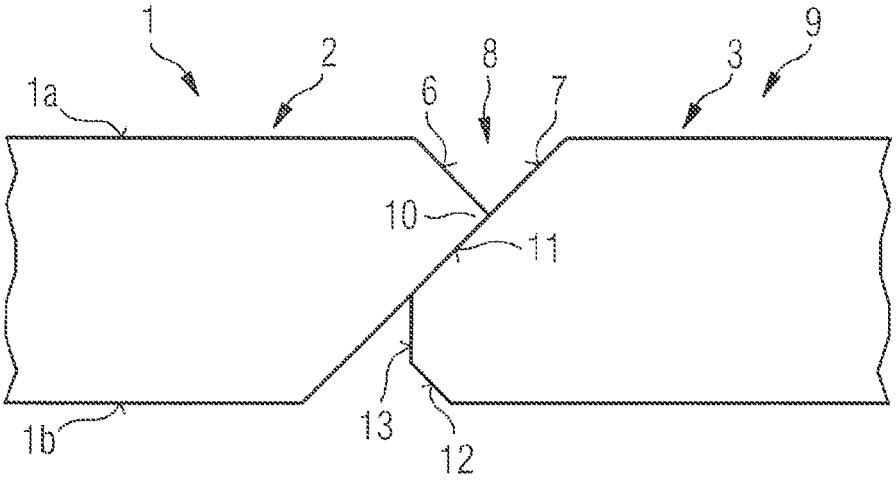
FIG. 2 shows mutually opposite panel edges of a panel according to the invention in the connected condition.

FIG. 2 shows oppositely disposed panel edges 2 and 3 of a panel 1. The panel has a panel top side 1*a* and a panel underside 1*b*. At the panel top side 1*a* the panel edge 2 is respectively provided with an edge break and the panel edge 3 is respectively provided with an edge break which is larger than the edge break of the panel edge 2. Both edge breaks are in the form of a 45° bevel. In the illustrated connected condition the small edge break 6 and a part of the large edge break 7 together form a V-shaped join 8 in a covering surface 9. In the connected condition a lower part of the large edge break 7 of the panel edge 3 is overlapped by the small edge break 6 of the oppositely disposed panel edge.

In the embodiment shown in FIG. 2 an undercut contour having a lateral projection 10 is provided at the panel edge 2 in an upper region near the panel top side 1*a*, wherein the small edge break 6 is arranged directed towards the panel top side, that is to say upwardly, at the lateral projection 10 of that contour. The lateral projection forms the distal region of the panel edge. It projects laterally furthest from the panel edge.

The lateral projection has a locking surface 11 facing towards the panel underside 1*b*.

In the connected condition the overlapped part of the large edge break 7 of the panel edge 3 is oriented in parallel in relation to the locking surface 11 provided downwardly on the lateral projection 10 of the panel edge 2. In the embodiment of FIG. 2 the lateral projection 10 is in the form of an asymmetrical point. An upper flank of the point is formed by the small edge break 6 and a lower flank of the point includes the locking surface 11 of the lateral projection 10. The lower flank is extended in aligned relationship and extends down to the panel underside 1*b*.

The panel edge 3 provided with the large edge break 7, at the panel underside 1*b*, has a lower edge break 12 in the form of a 45° bevel. Extending between the edge break 7 and the edge break 12 is a free butting surface 13 which is perpendicular to the panel top side.

Figure 3:
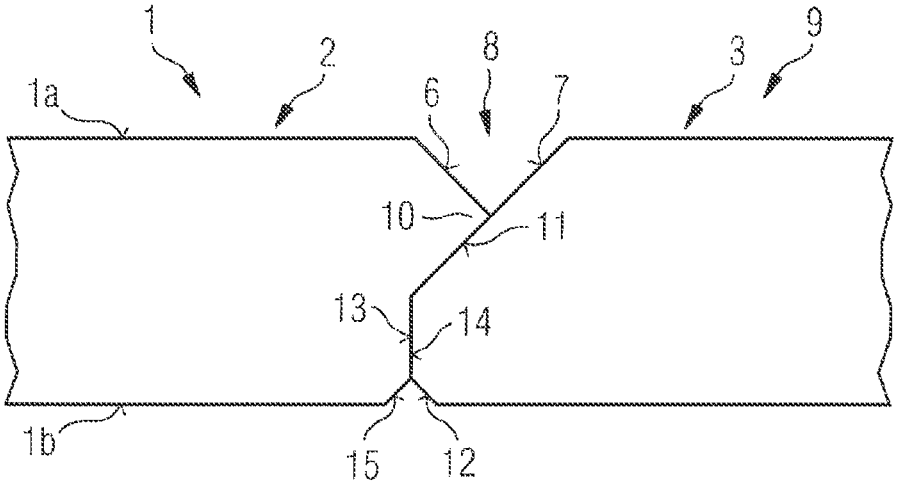
FIG. 3 shows mutually opposite panel edges of an alternative embodiment of a panel according to the invention in the connected condition.

FIG. 3 shows an alternative embodiment in which the panel edge 3 also has a free butting surface 13, from which the large edge break 7 extends upwardly towards the panel top side 1*a*. A lower edge break 12 extends from the free butting surface 13 towards the panel underside 1*b*. The contour of the panel edge corresponds in principle to that shown in FIG. 2. In FIG. 3 however there is a panel edge 2 which differs from that shown in FIG. 2, more specifically in that the locking surface 11 provided downwardly on the lateral projection 10 is not extended in aligned relationship as far as the panel underside 1*b*. Instead there is provided a set-back butting surface 14 oriented perpendicularly to the panel top side 1*a*. The set-back butting surface 14 of the panel edge 2 cooperates with the free butting surface 13 of the panel edge 3, the surfaces abutting against each other and limiting the joining movement when the panel edges 2 and 3 are moved towards each other. In addition the overlapped part of the large edge break 7 is also contacted by the locking surface 11 of the lateral projection.

At the panel underside 1*b* the panel edge 2 is provided with a lower edge break 15 which is in the form of a 45° bevel symmetrically with respect to the lower edge break 12 of the panel edge 3.

Figure 4:
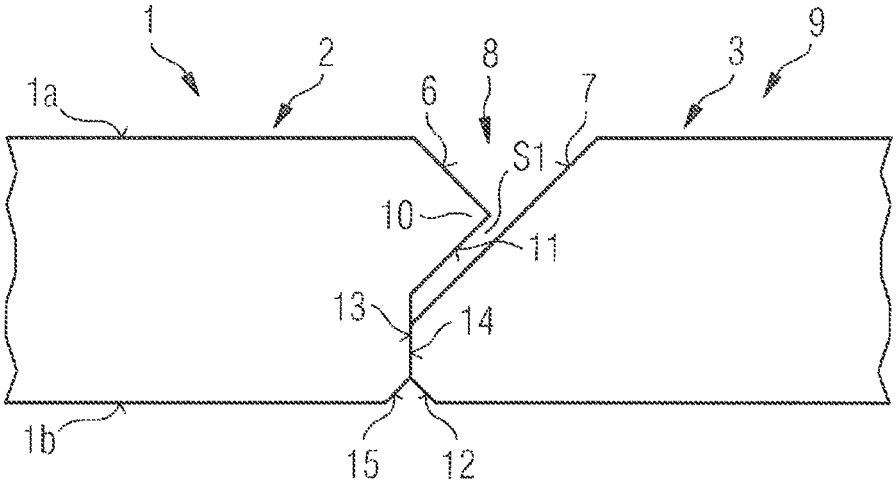
FIG. 4 shows a development of the embodiment of FIG. 3.

FIG. 4 shows a development of the previous embodiment. This development differs by virtue of a gap S1 which occurs between the locking surface 11 and the overlapped part of the large edge break 7 when the panel edges 2 and 3 are fitted together. In this embodiment contact of the panel edges 2 and 3 only occurs instead between the free butting surface 13 of the panel edge 3 and the set-back butting surface 14 of the panel edge 2.

Figure 5:
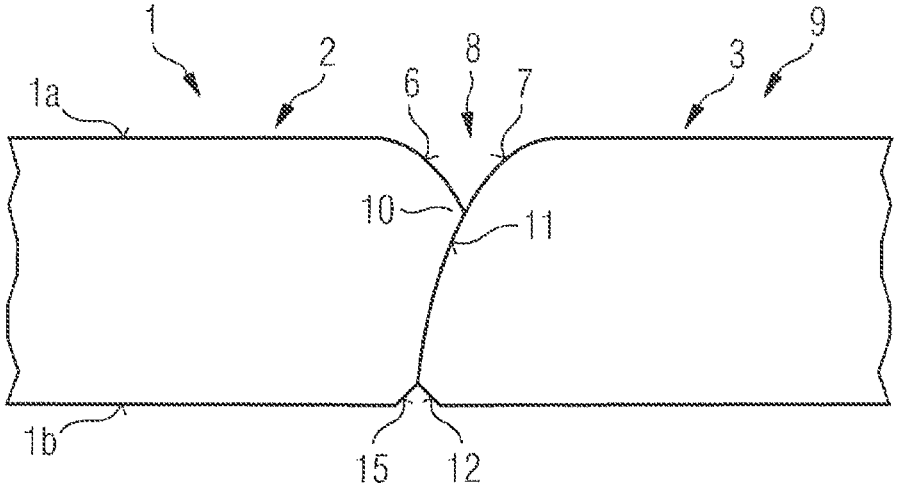
FIG. 5 shows mutually opposite panel edges of a further embodiment of a panel according to the invention in the connected condition.

FIG. 5 shows an embodiment of the panel in which the edge breaks have rounded portions. The join which occurs in the connected condition is substantially V-shaped, but with curved limbs of the V-shape. The V-shape limbs project towards the interior of the V-shaped cross-section of the join.

The large edge break 7 is again overlapped by the small edge break 6. The small edge break 6 is arranged at a lateral projection 10 and has a locking surface 11 directed towards the panel underside. The overlapped part of the large edge break 7 extends with a curvature under the small edge break 6 and is in contact with the locking surface 11 which has a curvature matching same.

At the panel underside 1*b* the panel edge 2 is provided with a lower edge break 15 which is in the for of a 45° bevel symmetrically relative to the lower edge break 12 of the panel edge 3.

Figure 6:
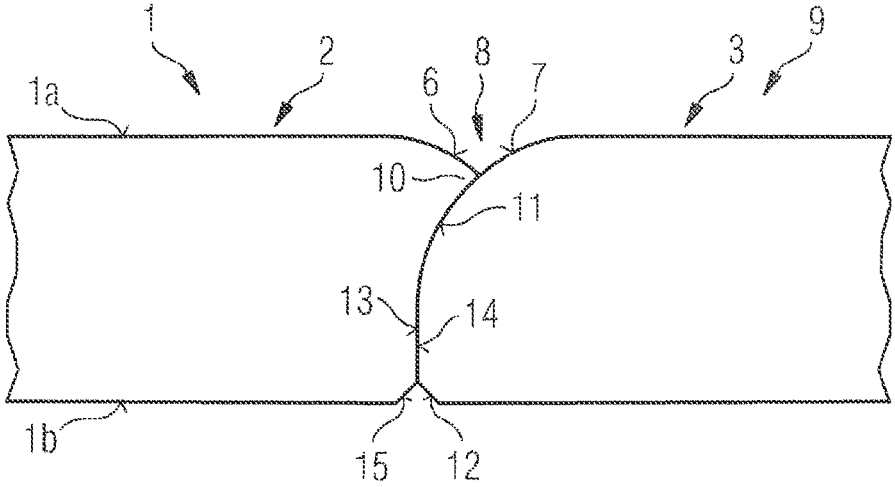
FIG. 6 shows mutually opposite panel edges of a further embodiment of a panel according to the invention in the connected condition.

FIG. 6 differs from the previous embodiment in substance by modified rounded configurations of the edge breaks. Here the large edge break 7 of the panel edge 3 is in the shape of a quarter of a circle. The small edge break 6 of the panel edge 2 is of a radius of the same size as the radius of the quarter circle of the panel edge 3.

Figure 7:
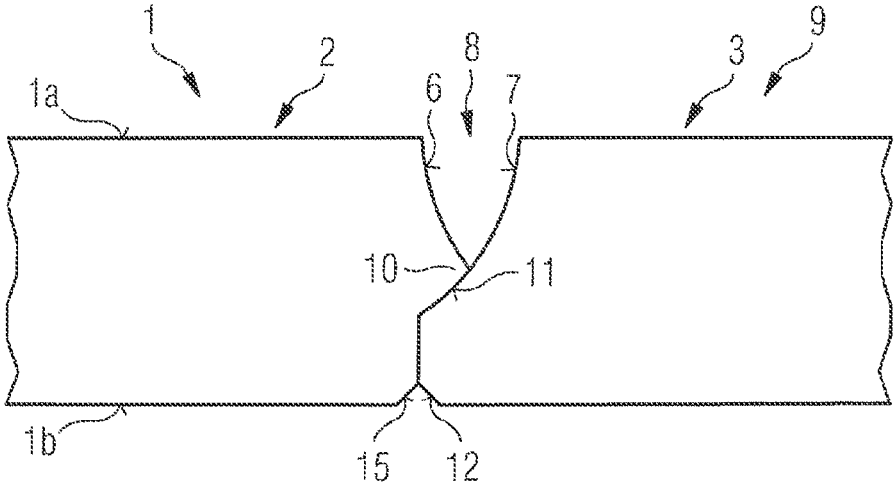
FIG. 7 shows mutually opposite panel edges of an alternative embodiment of a panel according to the invention with a large join in the connected condition.

FIG. 7 shows an embodiment for edge breaks in the form of rounded portions which however have their center point outside the panel cross-section. The rounded portions are of a configuration in the manner of a hollow fillet. Together they form a V-shaped join 8, wherein the V-limbs are curved outwardly so that they enlarge the V-shaped cross-section. In this embodiment also a lateral projection 10 is provided with a locking surface 11 directed towards the panel underside 1*b*, wherein the locking surface 11 provided downwardly on the lateral projection 10 is of an arcuate configuration and its radius is adapted to the radius of the overlapped part of the large edge break 7 of the panel edge 3. The panel edge 3 also has a free butting surface 13 and the panel edge 2 has a set-back butting surface 14, as in FIG. 3. In the connected condition of the panel edges 2 and 3 they are in contact with each other. At the panel underside 1*b* the panel edge 2 is provided with a lower edge break 15 which is in the form of a 45° bevel symmetrically relative to the lower edge break 12 of the panel edge 3.

Figure 8:
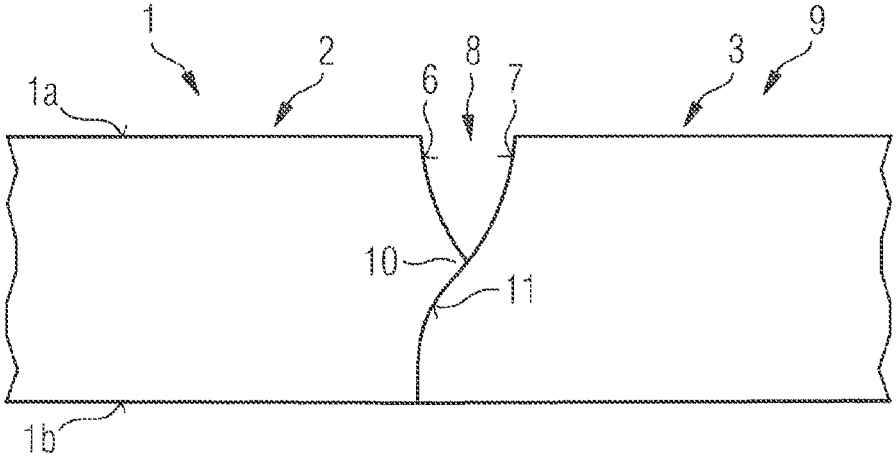
FIG. 8 shows mutually opposite panel edges of a further embodiment of a panel according to the invention with a large join in the connected condition.

The embodiment of FIG. 8 is based on that shown in FIG. 7. It includes the hollow fillet-shaped small edge break 6 in an identical configuration. The large edge break 7 is also in the form of a hollow fillet in the region which is not overlapped and which forms the one side of the join. In the overlapped region however the rounded configuration is not hollow fillet-shaped but is turned outwardly. In addition there is no edge break at the panel underside, which also represents a possible alternative in all preceding embodiments. Equally the present configuration as shown in FIG. 8 could have edge breaks as in the previous embodiments.

The surface nature of the panel underside is adapted for good adhesion of an adhesive.

Reference is made to FIG. 4 to describe an embodiment with 45° bevels at the panel top side, wherein this embodiment has a gap S1 when the panel edges 2 and 3 are connected. It will be appreciated that the embodiments of FIGS. 5 through 8 can also be modified in such a way that, beneath the locking surface 11 of the lateral projection 10 of the panel edge 2, there is a gap when the panel edges 2 and 3 are connected together.

Figure 9:
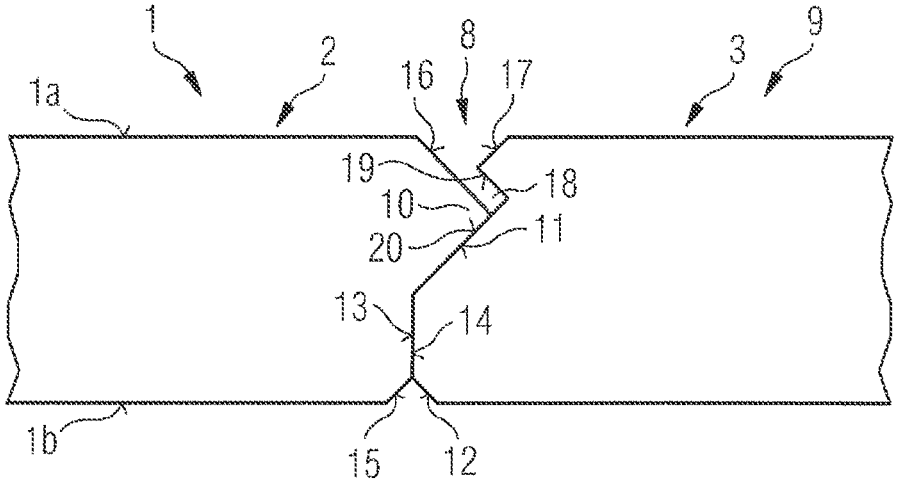
FIG. 9 shows mutually opposite panel edges of another embodiment of the panel according to the invention.

A further embodiment of a panel is shown in FIG. 9. This panel 1 again has mutually opposite panel edges 2 and 3 and the panel has a panel top side 1*a* and a panel underside 1*b*. At the panel top side 1*a* the panel edge 2 is respectively provided with an edge break 16 and the panel edge 3 is respectively provided with an edge break 17, wherein in this case the edge break 16 of the panel edge 2 is larger than the edge break 17 of the panel edge 3. Both edge breaks are in the form of a 45° bevel. In the connected condition as illustrated the small edge break 17 and a part of the large edge break 16 together form a V-shaped join 8 in a covering surface 9. A lower part of the large edge break 16 of the panel edge 2 in the connected condition is overlapped by the small edge break 17 of the oppositely disposed panel edge 3.

The large edge break 16 is disposed at a lateral projection 10 which has a locking surface 11 facing towards the panel underside 1*b*. Adjoining the locking surface 11 is a butting 14 which in the present example is arranged perpendicularly to the panel top side 1*a*.

Beneath the small edge break 17 the panel edge 3 has a recess 18. The recess 18 has an undercut recess surface 19. A lower surface 20 of the recess blends in aligned relationship into a locking surface which cooperates with the complementary locking surface 11 of the panel edge 2.

The projection 10 of the panel edge 2 projects into the recess 18 of the panel edge 3. In that case the large edge break 16 is not in contact with the undercut recess surface 19 of the recess 18.

At the panel underside 1*b* the panel 2, as in FIG. 3, is provided with a lower edge break 15 which is in the form of a 45° bevel symmetrically relative to a lower edge break 12 of the panel edge 3.

Figure 10:
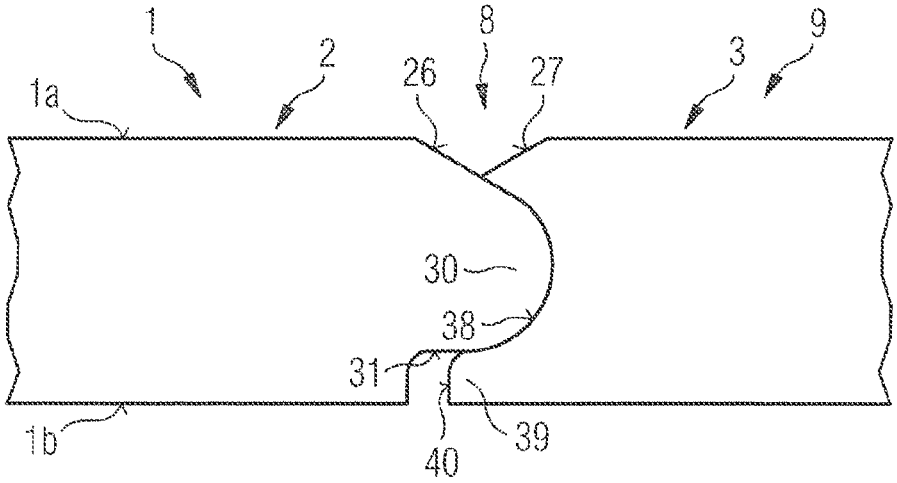
FIG. 10 shows mutually opposite panel edges of still a further embodiment of the panel according to the invention.

A further embodiment is shown in FIG. 10. As in the previous embodiment, FIG. 10 also shows two oppositely disposed panel edges 2 and 3 of a panel type in the connected condition. The panel again has a panel top side 1*a* and panel underside 1*b*. At the panel top side 1*a* the panel edge 2 is provided with an edge break 26 and the panel edge 3 is provided with an edge break 27, the edge break 26 of the panel edge 2 being larger than the edge break 27 of the panel edge 3. Both edge breaks are in the form of a bevel. In the illustrated connected condition the small edge break 27 and a part of the large edge break 26 together form a V-shaped join 8 in a covering surface 9. A lower part of the large edge break 26 of the panel edge 2 is overlapped in the connected condition by the small edge break 27 of the opposite panel edge 3.

In addition there is a lateral projection 30 at which the large edge break 26 is provided. The projection 30 has a free end, the cross-section of which is rounded (convexly). Matching same the complementary panel edge 3 has a recess 38 of round cross-section (concave). At the top side of the projection 30 the rounded configuration thereof passes tangentially into the large edge break 26 which is in the form of a bevel. At the underside of the projection 30 it goes into a surface 31 arranged almost parallel to the plane of the panel.

The round recess 38 of the panel edge 3 has a lower wall 39 having a free end 40 which in the connected condition of the panel edges 2 and 3 is at a spacing relative to the complementary panel edge 2.

The rounded configuration of the projection 30 is closely matched tot the round cross-section of the recess 38. That provides for precise positioning (centering) and at the same time that gives a locking action which acts to prevent locked panel edges from moving away from each other perpendicularly to the plane of the panel.

While specific embodiments of the invention have been shown and described in detail to illustrate the inventive principles, it will be understood that the invention may be embodied otherwise without departing from such principles.

We claim:

1. A panel, comprising: a panel top side; a panel underside; and at least two mutually opposite panel edges, which respectively have an edge break at the panel top side, wherein the edge breaks in a connected condition of two of the panels together form a joint in a covering surface, wherein the edge break of a first of the panel edges is a larger edge break than the edge break of the opposite, second panel edge and the edge break of the opposite, second panel edge is a smaller edge break, wherein the first and second panel edges each have a butting surface, wherein the smaller edge break has an undercut with a surface, and wherein a lower part of the larger edge break of the first panel edge in the connected condition is overlapped by the smaller edge break of the opposite, second panel edge so that an overlap area is formed between the smaller edge break and the larger edge break, wherein in the connected condition in the overlap area an upper surface of the larger edge break is parallel to the undercut surface of the smaller edge break and a slot is formed between the upper surface of the larger edge break and the undercut surface of the smaller edge break when the butting surface of the first panel edge butts the butting surface of the second panel edge.

2. The panel according to claim 1, wherein one of the panel edges has an undercut contour having a lateral projection in an upper region near the panel top side and the smaller edge break is disposed upwardly at the lateral projection of said contour.

3. The panel according to claim 2, wherein at least one of the edge breaks is formed as a bevel.

4. The panel according to claim 2, wherein the lateral projection of the contour has a locking surface directed towards the panel underside.

5. The panel according to claim 2, wherein a set-back butting surface is provided between the panel underside and the lateral projection.

6. The panel according to claim 2, wherein the panel edge with the lateral projection has a lower edge break which is equal to or larger than the lower edge break of the complementary panel edge.

7. A panel according to claim 2, wherein the lateral projection forms a distal area of the panel edge.

8. The panel according to claim 1, wherein the at least two mutually opposite panel edges each have a lower edge break at the panel underside.

9. The panel according to claim 1, wherein the panel underside is an adhesive underside.

10. A method of adhesively bonding a panel according to claim 1, comprising the step of applying adhesive to the panel underside so that an edge region of the panel underside remains free of adhesive.

11. A method according to claim 10, wherein when the panel is pressed against a substrate, the adhesive flows to the edge region of the panel underside and in part passes between the panel edges.

12. A panel according to claim 1, wherein the gap in the overlap area is between the entire undercut surface of the smaller edge break and the upper surface of the larger edge break.

* * * * *